US009784045B2

(12) United States Patent
Binetruy et al.

(10) Patent No.: US 9,784,045 B2
(45) Date of Patent: Oct. 10, 2017

(54) CONTINUOUS ROD CENTRALIZER

(71) Applicants: Gerald L Binetruy, Lloydminster (CA); Mark J Binetruy, Lloydminster (CA)

(72) Inventors: Gerald L Binetruy, Lloydminster (CA); Mark J Binetruy, Lloydminster (CA)

( * ) Notice: Subject to any disclaimer, the term of this patent is extended or adjusted under 35 U.S.C. 154(b) by 457 days.

(21) Appl. No.: 13/951,509

(22) Filed: Jul. 26, 2013

(65) Prior Publication Data

US 2014/0027107 A1 Jan. 30, 2014

(30) Foreign Application Priority Data

Jul. 27, 2012 (CA) ..... 2784269

(51) Int. Cl.
*E21B 17/10* (2006.01)

(52) U.S. Cl.
CPC ..... *E21B 17/1042* (2013.01); *E21B 17/105* (2013.01); *E21B 17/1071* (2013.01)

(58) Field of Classification Search
None
See application file for complete search history.

(56) References Cited

U.S. PATENT DOCUMENTS 5,339,896 A * 8/1994 Hart ..... E21B 17/1042 166/241.1
5,755,284 A * 5/1998 Hart ..... E21B 17/1042 166/176
2005/0082056 A1* 4/2005 Baxter ..... E21B 17/1085 166/241.6
2013/0292183 A1* 11/2013 Eidem ..... E21B 17/105 175/325.5

* cited by examiner

*Primary Examiner* — Caroline N Butcher
(74) *Attorney, Agent, or Firm* — Davis & Bujold PLLC; Michael J. Bujold

(57) ABSTRACT

A continuous rod centralizer has a cylindrical centralizer body with a first end, a second end, an interior surface defining a bore which receives the continuous rod, and vanes extending radially from the exterior surface. A first rod clamp clamps onto the continuous rod at the first end of the body to confine movement of the body along the continuous rod in a first direction. A second rod clamp clamps onto the continuous rod at the second end of the body to confine movement of the body along the continuous rod in a second direction.

12 Claims, 5 Drawing Sheets

CONTINUOUS ROD CENTRALIZER

FIELD

There is described a centralizer which was developed for use on a continuous rod.

BACKGROUND

Continuous rod is now replacing sucker rod strings consisting of multiple connected sucker rods lengths in oil well pumping applications. A continuous rod only requires two connections: one at the top and one at the bottom. Reducing the number of connections serves to reduce the severity of both tubing and rod wear. When continuous rod is used, there is no need for centralizers and rods guides in most wells. However, it has been discovered that excessive wear is occurring in some wells. Upon investigation it has been determined that the wells in question have one or more curved sections. Some such wells have what could be termed a serpentine profile. Although centralizers per se are well known, there are presently not any centralizers that are particularly adapted for use on continuous rod. What is required is a centralizer suited for use with continuous rod.

SUMMARY

There is provided a continuous rod centralizer, comprising a cylindrical centralizer body having a first end, a second end, an interior surface defining a bore which receives the continuous rod, and vanes extending radially from the exterior surface. A first rod clamp clamps onto the continuous rod at the first end of the body to confine movement of the body along the continuous rod in a first direction. A second rod clamp clamps onto the continuous rod at the second end of the body to confine movement of the body along the continuous rod in a second direction.

According to another aspect, the centralizer body may comprise an exterior surface with a continuous rod insertion opening that extends between the first end and the second end.

According to an aspect, the centralizer body may be of a resilient material and the continuous rod insertion opening is in a normally closed position, where the continuous rod insertion opening flexes open to facilitate insertion of the continuous rod and then resiliently returning to its original closed position.

According to an aspect, each of the first rod clamp and the second rod clamp may comprise a first clamp portion having a convex outer surface and a concave inner surface, a second clamp portion having a convex outer surface and a concave inner surface, and fasteners maintaining the concave inner surface of the first clamp portion and the concave inner surface of the second clamp portion clamped onto the continuous rod. The fasteners may be screws.

According to an aspect, each of the first rod clamp and the second rod clamp may have a centralizer body engaging end, a remote end and a convex outer surface, the outer surface tapering towards a reduced diameter at the remote end.

According to an aspect, the first and second rod clamps may each have a centralizer body engaging end and a remote end, the centralizer body engaging end having a first inner recess that retains a respective end of the centralizer body, the recess being sized to permit rotation of the centralizer body relative to the first and second rod clamps and being located immediately adjacent to the centralizer body engaging end of the respective clamp. The continuous rod centralizer may further comprise an inner sleeve placed between the cylindrical centralizer body and the continuous rod, the inner sleeve extending past both the first and second ends of the cylindrical centralizer body, a second inner recess on the first and second rod clamps that receives a respective end of the inner sleeve wherein the second recess has a reduced diameter relative to the diameter of the first recess. The second recess may be sized to hold the inner sleeve in a fixed position relative to the first and second rod clamps.

According to another aspect, there is provided a continuous rod centralizer, comprising a cylindrical centralizer body having a first end, a second end, an exterior surface with a continuous rod insertion opening that extends between the first end and the second end. An interior surface defines a bore that receives the continuous rod, and vanes extend radially from the exterior surface. A first rod clamp clamps onto the continuous rod at the first end of the body to confine movement of the body along the continuous rod in a first direction. A second rod clamp that clamps onto the continuous rod at the second end of the body to confine movement of the body along the continuous rod in a second direction. An inner sleeve is placed between the cylindrical centralizer body and the continuous rod, the inner sleeve extending past both the first and second ends of the cylindrical centralizer body. The first and second rod clamps further comprise a first inner recess that retains a respective end of the centralizer body, the recess being sized to permit rotation of the centralizer body relative to the first and second rod clamps and being located immediately adjacent to the centralizer body engaging end of the respective clamp. There is A second inner recess on the first and second rod clamps that receives a respective end of the inner sleeve wherein the second recess has a reduced diameter relative to the diameter of the first recess.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
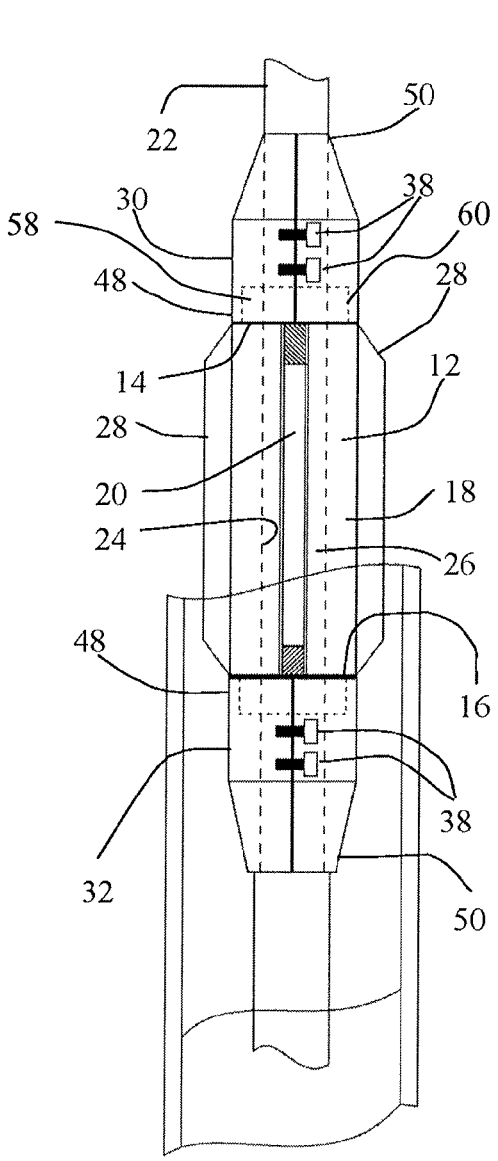
FIG. 1 is a side elevation view of a continuous rod centralizer.

A continuous rod centralizer, generally identified by reference numeral 10, will now be described with reference to FIG. 1 through 6*b*.

Figure 6A:
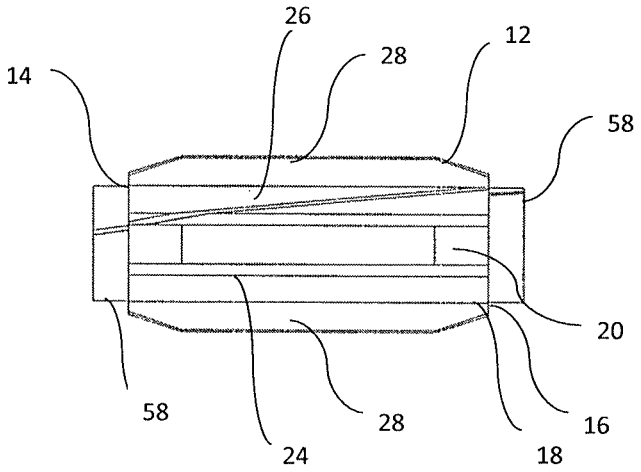
FIG. 6*a* is a side elevation view of a variation of a continuous rod centralizer body.
Figure 6B:
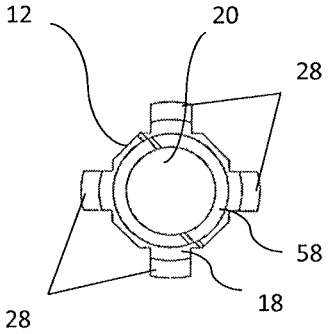
FIG. 6*b* is an end elevation view of the continuous rod centralizer body of FIG. 6*a*.

Structure and Relationship of Parts:

Referring to FIG. 1, a continuous rod centralizer 10 has a cylindrical centralizer body 12 with a first end 14 and a second end 16. Referring to FIGS. 6*a* and 6*b*, body 12 is made of a resilient material that is capable of flexing and returning to its original state. Body 12 has an exterior surface 18 with a continuous rod insertion opening 20 that extends between the first end 14 and the second end 16. The continuous rod insertion opening 20 is in a normally closed position and flexes open to facilitate insertion of the continuous rod 22 and then resiliently returns to its original closed position. An interior surface 24 defines a bore 26 which receives the continuous rod 22, as shown in FIG. 1. Alternatively, body 12 may be made from multiple parts, in which case, rather than inserting continuous rod 22 into insertion opening 20, the parts of body 12 are placed around continuous rod 22. However, a single piece construction as depicted provides additional structural support to body 12. Also, as shown, insertion opening 20 is at an angle relative to the axis of continuous rod 22, such that it curves around body 12.

Referring to FIG. 1, vanes 28 extend radially from the exterior surface 18. The engagement between body 12 and continuous rod 22 allows for free relative rotation. In other words, body 12 can remain stationary while continuous rod 22 rotates or continuous rod 22 can remain stationary while body 12 rotates. This relative rotation is a desired feature. However, body 12 will also slide longitudinally along continuous rod 22. In order to stop longitudinal movement of body 12 from occurring, rod clamps are used. A first rod clamp 30 clamps onto continuous rod 22 at the first end 14 of the body 12 with a first recess 60 accommodating the end 58 of the centralizer body 12 and allowing free relative rotation. This confines movement of the body 12 along the continuous rod 22 in a first direction. A second rod clamp 32 clamps onto continuous rod 22 at the first end 14 of the body 12 with a first recess 60 accommodating the other end 58 of centralizer body 12 and allowing free relative rotation. This confines movement of the body 12 along the continuous rod 22 in a second direction.

Figure 2:
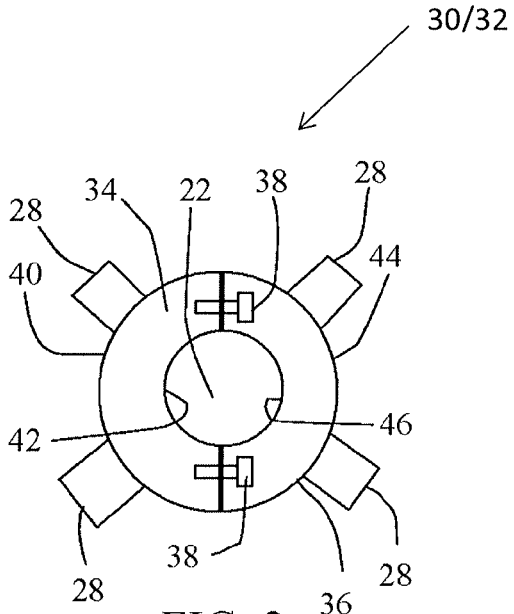
FIG. 2 is a top plan view of the continuous rod centralizer shown in FIG. 1.

Referring to FIG. 2, in the embodiments shown, each of the first rod clamp 30 and the second rod clamp 32 include a first clamp portion 34, a second clamp portion 36 and fasteners, such as set screws 38. The first clamp portion 34 has a convex outer surface 40 and a concave inner surface 42. The second clamp portion 36 has a convex outer surface 44 and a concave inner surface 46. The screws 38 maintain the concave inner surface 42 of the first clamp portion 34 and the concave inner surface 48 of the second clamp portion 36 clamped onto the continuous rod 22.

Referring to FIG. 1, each of the first rod clamp 30 and the second rod clamp 32 have a centralizer body engaging end 48 and a remote end 50. The remote end 50 is tapered away from the centralizer body 12 and inwardly from the convex outer surface 40, 44 toward the concave inner surface 42, 46.

Figure 3:
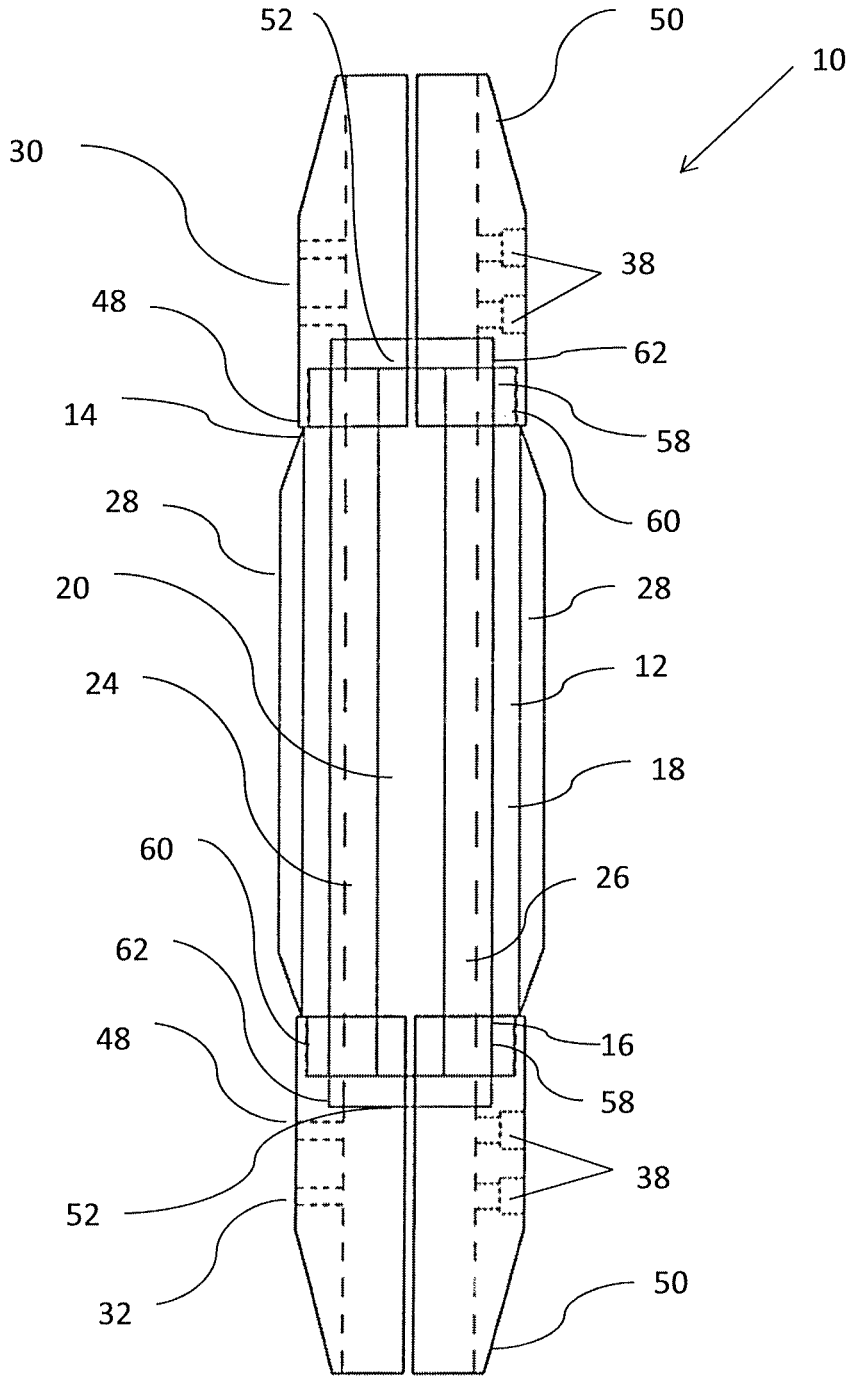
FIG. 3 is a side elevation view of a variation of a continuous rod centralizer.
Figure 4:
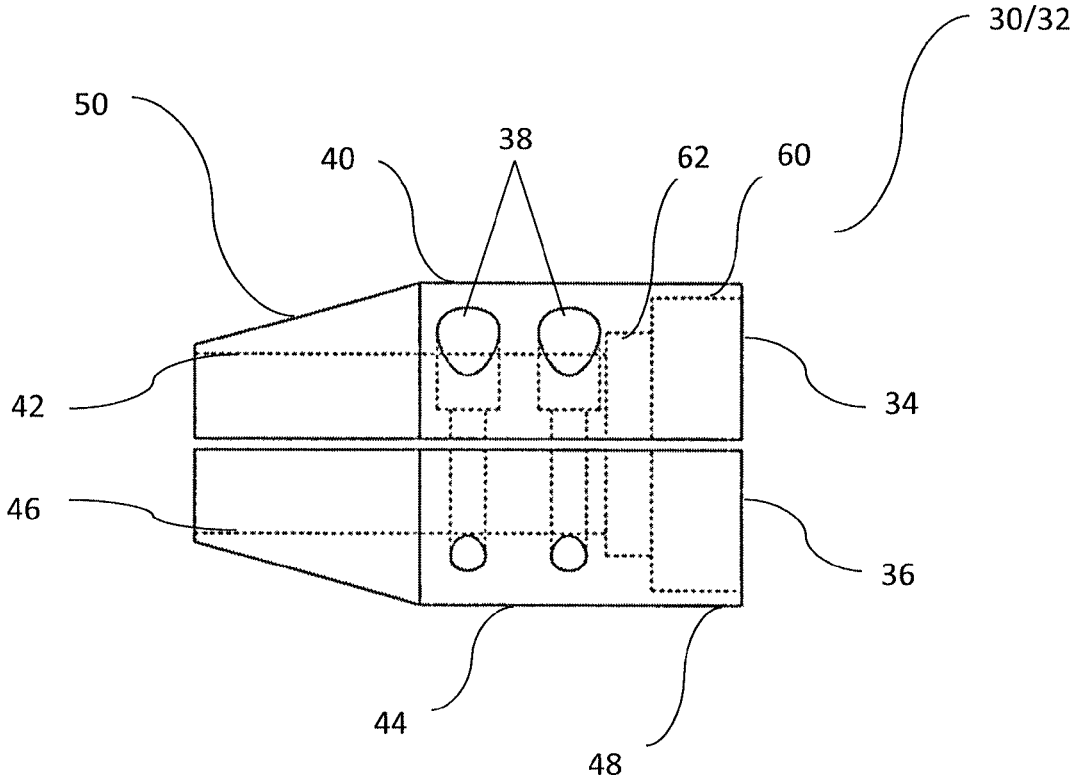
FIG. 4 is a side elevation view of a variation of a rod clamp.

Referring to FIG. 3, centralizer 10 may have an inner sleeve 52 between centralizer body 12 and continuous rod 22. Inner sleeve 52 is used to prevent sand and other debris from becoming trapped against continuous rod 22 and causing damage to rod 22. Inner sleeve 52 is securely attached to continuous rod by first rod clamp 30 and second rod clamp 32. Referring to FIG. 4, first and second rod clamps 30 and 32 each has recesses 60 and 62. First recess 60 receives body 12 while second recess 62 receives inner sleeve 52, as shown in FIG. 3. Recess 60 is loose enough to permit free relative rotation of body 12 while second recess 62 clamps on inner sleeve 52. The purpose of clamping inner sleeve 52 to continuous rod 22 is to protect continuous rod 22 from unnecessary wear due to the movement of body 12. In order to achieve this, the clamping is preferably sufficient to create a seal against debris and other solids from entering between sleeve 52 and continuous rod 22. The clamping is also preferably sufficient to prevent relative rotation of sleeve 52 and continuous rod 22.

Figure 5A:
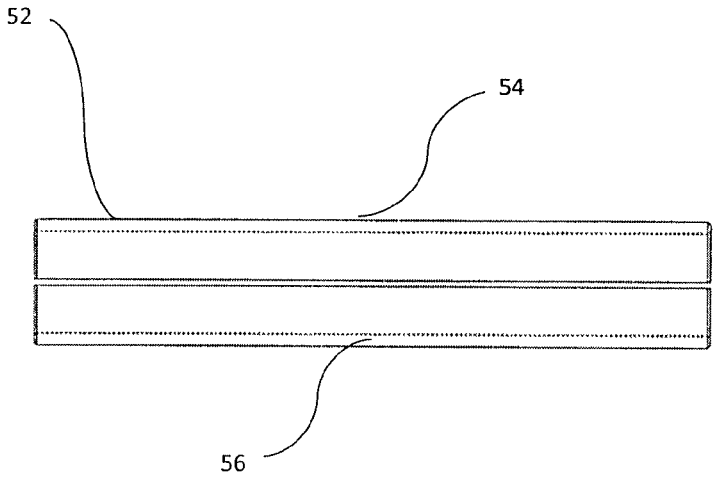
FIG. 5*a* is a side elevation view of an inner sleeve to be used in a variation of a continuous rod centralizer.
Figure 5B:
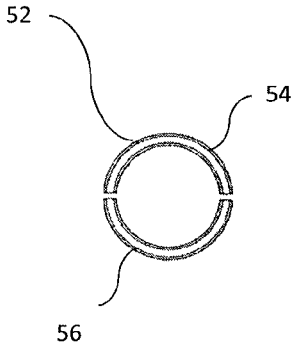
FIG. 5*b* is an end elevation view of the inner sleeve of FIG. 5*a*.

Referring to FIG. 5, inner sleeve 52 is preferably a rigid material and therefore segmented to allow it to be installed. As shown, inner sleeve 52 has a first portion 54 and a second portion 56.

Operation:

Referring to FIG. 1, body 12 of continuous rod centralizer 10 is positioned around a continuous rod 22 by flexing continuous rod insertion opening 20 to the open position and sliding continuous rod 22 into bore 26. Continuous rod insertion opening 20 then returns to the closed position and is, thereby, positioned on continuous rod 22. First rod clamp 30 is clamped onto continuous rod 22 at the first end 14 allowing centralizer body end 58 in first recess 60 to have free relative movement. This confines movement of the body 12 along the continuous rod 22 in a first direction. Second rod clamp 32 is clamped onto continuous rod 22 at the second end 16 allowing centralizer body end 58 in first recess 60 to have free relative movement. This confines movement of the body 12 along the continuous rod 22 in a second direction. Referring to FIG. 2, first rod clamp 30 and second rod clamp 32 are clamped onto the continuous rod 22 by clamping the first clamp portion 34 to the second clamp portion 36 using set screws 38 such that the concave inner surfaces 42 and 46 clamp onto the continuous rod 22. It is important that this clamping action hold body 12 in position without creating marks on continuous rod 22 through which corrosive fluids could degrade continuous rod 22.

Referring to FIG. 3, variation continuous rod centralizer 10 has an inner sleeve 52 placed on continuous rod 22 in a manner which allows no movement between inner sleeve 52 and continuous rod 22. First rod clamp 30 and second rod clamp 32 have a second recess 62 which is sized to clamp onto inner sleeve 52 allowing no movement between inner sleeve 52 and each respective rod clamp. Referring to FIG. 5, inner sleeve 52 is composed of first inner sleeve portion 54 and second inner sleeve portion 56. First inner sleeve portion 54 and first inner sleeve portion 56 are attached to continuous rod in a manner that does not allow movement.

Cautionary Warnings:

Care must be taken regarding the type of resilient materials used in the construction of the centralizer body. There are some resilient materials that easily become shredded and can potentially clog the pump. Beneficial results have been obtained through the use of TEFLON (Trademark) materials.

It is preferable that the screws used as fasteners be recessed into one of the first rod clamp or the second rod clamp, so as not to collect debris or influence fluid flow.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the claims should not be limited by the illustrated embodiments set forth as examples, but should be given the broadest interpretation consistent with a purposive construction of the claims in view of the description as a whole.

What is claimed is:

1. A continuous rod centralizer comprising:

a centralizer body having a first end, a second end, an interior surface defining a bore which receives the continuous rod, an exterior surface with a continuous rod insertion opening that extends between the first end and the second end, and vanes extending radially from the exterior surface;

a first rod clamp that clamps onto the continuous rod at the first end of the body to confine movement of the body along the continuous rod in a first direction; and a second rod clamp that clamps onto the continuous rod at the second end of the body to confine movement of the body along the continuous rod in a second direction;

wherein the first and second rod clamps each have a centralizer body engaging end and a remote end, the centralizer body engaging end has a first inner recess that retains a respective end of the centralizer body, the recess is sized to permit rotation of the centralizer body relative to the first and second rod clamps and is located immediately adjacent to the centralizer body engaging end of the respective clamp.

2. The continuous rod centralizer of claim 1, wherein the centralizer body is of a resilient material and the continuous rod insertion opening is in a normally closed position, the continuous rod insertion opening flexing open to facilitate insertion of the continuous rod and then resiliently returning to its original closed position.

3. The continuous rod centralizer of claim 1, wherein each of the first rod clamp and the second rod clamp comprise:

a first clamp portion having a convex outer surface and a concave inner surface;

a second clamp portion having a convex outer surface and a concave inner surface; and fasteners maintaining the concave inner surface of the first clamp portion and the concave inner surface of the second clamp portion clamped onto the continuous rod.

4. The continuous rod centralizer of claim 3, wherein the fasteners are screws.

5. The continuous rod centralizer of claim 1, wherein each of the first rod clamp and the second rod clamp have a centralizer body engaging end, a remote end and a convex outer surface, the outer surface tapering towards a reduced diameter at the remote end.

6. The continuous rod centralizer of claim 1, further comprising: an inner sleeve placed between the centralizer body and the continuous rod, the inner sleeve extending past both the first and second ends of the centralizer body; and a second inner recess on the first and second rod clamps that receives a respective end of the inner sleeve wherein the second recess has a reduced diameter relative to the diameter of the first recess.

7. The continuous rod centralizer of claim 6, wherein the second recess is sized to hold the inner sleeve in a fixed position relative to the first and second rod clamps.

8. The continuous rod centralizer of claim 1, wherein the centralizer body comprises a cylindrical centralizer body.

9. The continuous rod centralizer of claim 1, wherein the centralizer body engaging end of each of the first and second rod clamps overlies a corresponding first or second end of the centralizer body to form an engagement surface between each of the first and second rod clamps and the centralizer body, each of the engagement surfaces being parallel to, a longitudinal axis of the centralizer body.

10. A continuous rod centralizer, comprising:

a centralizer body having a first end, a second end, an exterior surface with a continuous rod insertion opening that extends between the first end and the second end, an interior surface defining a bore which receives the continuous rod, and vanes extending radially from the exterior surface;

a first rod clamp that clamps onto the continuous rod at the first end of the body to confine movement of the body along the continuous rod in a first direction;

a second rod clamp that clamps onto the continuous rod at the second end of the body to confine movement of the body along the continuous rod in a second direction;

an inner sleeve placed between the centralizer body and the continuous rod, the inner sleeve extending past both the first and second ends of the centralizer body;

the first and second rod clamps further comprising:

a first inner recess that retains a respective end of the centralizer body, the recess being sized to permit rotation of the centralizer body relative to the first and second rod clamps and being located immediately adjacent to the centralizer body engaging end of the respective clamp; and a second inner recess on the first and second rod clamps that receives a respective end of the inner sleeve wherein the second recess has a reduced diameter relative to the diameter of the first recess.

11. The continuous rod centralizer of claim 10, wherein the centralizer body comprises a cylindrical centralizer body.

12. The continuous rod centralizer of claim 10, wherein each of the first and second rod clamps overlies a corresponding first or second end of the centralizer body to form an engagement surface between each of the first and second rod clamps and the first and second ends of the centralizer body, each of the engagement surfaces being parallel to a longitudinal axis of the centralizer body.

* * * * *